United States Patent [19]

Birch et al.

[11] 3,938,158

[45] Feb. 10, 1976

[54] ANTENNA ELEMENT FOR CIRCULAR OR LINEAR POLARIZATION

[75] Inventors: James D. Birch, Townsend; Max C. Mohr, Rockport, both of Mass.; Stephen R. Monaghan, Marshall Islands

[73] Assignee: Raytheon Company, Lexington, Mass.

[22] Filed: Dec. 19, 1973

[21] Appl. No.: 426,388

[52] U.S. Cl. ..... 343/756; 343/786; 333/21 A; 333/24.1; 333/24.3

[51] Int. Cl.[2].. H01Q 13/02; H01P 1/17; H01P 1/40

[58] Field of Search ..... 343/756; 333/21 A, 31 A

[56] References Cited

UNITED STATES PATENTS

| | | | |
|---|---|---|---|
| 3,100,894 | 8/1963 | Giller et al. | 343/756 |
| 3,287,730 | 11/1966 | Kerr | 343/756 |
| 3,626,335 | 12/1971 | Hord et al. | 333/21 A |
| 3,698,008 | 4/1971 | Roberts et al. | 333/24.1 |
| 3,753,160 | 8/1973 | Safran | 333/21 A |

*Primary Examiner*—Eli Lieberman
*Attorney, Agent, or Firm*—Richard M. Sharkansky; Philip J. McFarland; Joseph D. Pannone

[57] ABSTRACT

An antenna element for use in a phased array antenna is disclosed. Such antenna element is a reciprocal device adapted selectively to radiate radio frequency energy of either circular or linear polarization. Such antenna element includes waveguide means for passing radio frequency energy and for radiating such energy; and means adapted to transform the polarization of the radio frequency energy as such passes through the waveguide means to radiate such radio frequency energy selectively with either linear or circular polarization. In a preferred embodiment the just-mentioned means includes a first and a second nonreciprocal quarter-wave plate having field orientations effectively 45° with respect to each other. Such nonreciprocal quarter-wave plates flank a third nonreciprocal quarter-wave plate switchable so that its field orientation is either aligned with the field orientation of the first nonreciprocal quarter-wave plate or, while still aligned as before, turned 180°. Further, the third quarter-wave plate may be switched into a nonenergized state. A reciprocal quarter-wave plate is disposed between the radiating end of the waveguide means and the second nonreciprocal quarter-wave plate. A phase shifter section is disposed between the third nonreciprocal quarter-wave plate and the first nonreciprocal quarter-wave plate. When the field orientations of the first and the third quarter-wave plate are aligned, vertically polarized radio frequency energy introduced into the waveguide means is changed to radiate as horizontally polarized radio frequency energy. When the field orientation of the third quarter-wave plate is reversed by 180°, vertically polarized radio frequency energy introduced into the waveguide means is radiated as vertically polarized radio frequency energy. When the third quarter-wave plate is unenergized, vertically polarized radio frequency energy introduced into the waveguide means is changed to radiate as circularly polarized radio frequency energy. The phase shifter section, whatever the polarization of the radio frequency energy passing through, is operative to change, in accordance with a beam steering control signal, the phase of such energy.

3 Claims, 6 Drawing Figures

ANTENNA ELEMENT FOR CIRCULAR OR LINEAR POLARIZATION

BACKGROUND OF THE INVENTION

This invention relates generally to antenna elements and more particularly to phased array antenna elements of such type which are adapted selectively to radiate radio frequency energy of either circular or linear polarization.

As is known in the art, a collimated beam of radio frequency energy may be formed and steered by controlling the phase of the energy radiated from each one of a plurality of antenna elements in an array thereof. It is also known that in some applications, as where the effect of rain echos is to be reduced, it is desirable that the polarization of such radiated energy be circular. One such antenna element adapted for such application is described in U.S. Pat. No. 3,736,535 issued May 29, 1973, inventors Mohr et al, and assigned to the same assignee as the present invention. In other applications it is desirable that the polarization of the radiated energy be horizontal (as for terrain avoidance or terrain mapping applications) and, in still other applications, that polarization of such energy be vertical (as for acquisition, search or collision avoidance applications).

In view of the foregoing it is highly desirable that an antenna array be adapted selectively to radiate either circularly polarized radiation or linearly polarized radiation. Further, in order to simplify the beam steering electronics, it is further desirable that each antenna element in an array be a reciprocal device. With antenna elements of such nature, the same beam steering control signals may be applied during any reception period as were applied during a corresponding transmission period to direct transmitted energy in any desired direction.

SUMMARY OF THE INVENTION

With this background of the invention in mind it is therefore an object of this invention to provide improved antenna elements for a phased array antenna, each one of such elements being adapted selectively to radiate radio frequency energy having either circular or linear polarization.

It is a further object of this invention to provide improved antenna elements of such type as mentioned above, such elements being reciprocal devices, so that beam steering control signals applied during any transmit interval remain unchanged during a following receive interval.

These and other objects of the invention are attained generally by providing antenna elements, each including waveguide means for passing radio frequency energy and for radiating such energy; and means adapted to transform the polarization of the radio frequency energy as such passes through the waveguide means to radiate such radio frequency energy selectively with either linear or circular polarization. In a preferred embodiment the just-mentioned means includes a first and a second nonreciprocal quarter-wave plate having field orientations effectively 45° with respect to each other. Such nonreciprocal quarter-wave plates flank a third nonreciprocal quarter-wave plate switchable so that its field orientation is either aligned with the field orientation of the first nonreciprocal quarter-wave plate or, while still aligned as before, turned 180°. Further, the third quarter-wave plate may be switched into a nonenergized state. A reciprocal quarter-wave plate is disposed between the radiating end of the waveguide means and the second nonreciprocal quarter-wave plate. A phase shifter section is disposed between the third nonreciprocal quarter-wave plate and the first nonreciprocal quarter-wave plate. When the field orientations of the first and the third quarter-wave plate are aligned, vertically polarized radio frequency energy introduced into the waveguide means is changed to radiate as horizontally polarized radio frequency energy. When the field orientation of the third quarter-wave plate is reversed by 180°, vertically polarized radio frequency energy introduced into the waveguide means is radiated as vertically polarized radio frequency energy. When the third quarter-wave plate is unenergized, vertically polarized radio frequency energy introduced into the waveguide means is changed to radiate as circularly polarized radio frequency energy. The phase shifter section, whatever the polarization of the radio frequency energy passing through, is operative to change, in accordance with a beam steering control signal, the phase of such energy.

BRIEF DESCRIPTION OF THE DRAWINGS

Other objects and many of the attendant advantages of the invention will be readily appreciated as the same becomes better understood by reference to the following description of the accompanying drawings wherein.

DESCRIPTION OF THE PREFERRED EMBODIMENT

Figures 1, 2, 3, 4, 5:
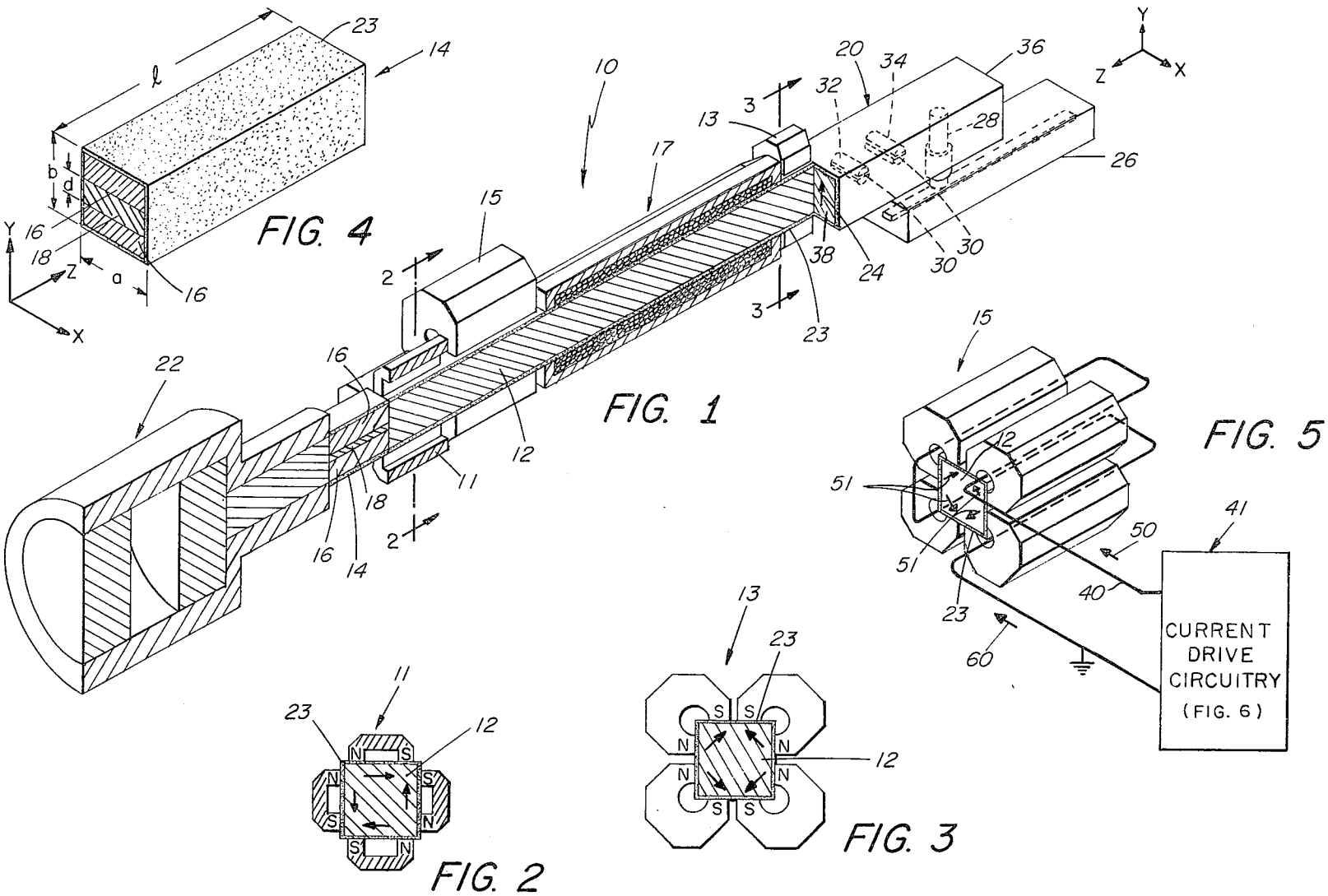
FIG. 1 is a sketch, somewhat simplified and partially cross-sectional about an axis of symmetry, of an antenna element according to the invention.
FIG. 2 is a complete cross-sectional view of one of the nonreciprocal quarter-wave plates shown in FIG. 1 taken along plane 2—2.
FIG. 3 is a cross-sectional view of another one of the nonreciprocal quarter-wave plates shown in FIG. 1 taken along plane 3—3.
FIG. 4 is an isometric view of a reciprocal quarter-wave plate shown in FIG. 1.
FIG. 5 is an isometric view of a switchable nonreciprocal quarter-wave plate of FIG. 1, such switchable nonreciprocal quarter-wave plate being shown coupled to current driver circuitry.

Referring now to FIG. 1, an antenna element 10 according to our concepts is shown to include: A pair of nonreciprocal quarter-wave plates 11, 13; a switchable nonreciprocal quarter-wave plate 15; a phase shifter section 17; an elongated ferrite rod 12, square in cross section and having a substantially rectangular magnetic hysteresis loop characteristic; a reciprocal quarter-wave plate 14, here a sandwich structure comprised of a pair of ceramic materials 16, 18; a feed transition section 20; and a radiator 22, all arranged as shown and operative in a manner to be described. Ferrite rod 12 is affixed to reciprocal quarter-wave plate 14 and feed transition section 20 by a suitable epoxy, not shown, to form a unitary structure. The unitary structure is machined to a desired dimension and then is overlaid with a thin metallic skin 23, (gold having been used in the preferred embodiment) to form a waveguide structure between the reciprocal quarter-wave plate 14 and the feed transition section 20. The radiator 22 is affixed to one end of the waveguide structure in any convenient manner, as by a suitable epoxy not here shown. The feed transition section 20 is used to introduce ratio frequency energy having a vertical polarization (i.e. an electric field oriented as indicated by the arrow 24, parallel to the Y axis) into the illustrated waveguide structure during a transmission. Such radio frequency energy passes through the waveguide structure and is radiated into free space by means of radiator 22, such radio frequency energy having selectively either horizontal, vertical or circular polarization in a manner to be described hereinafter.

Referring now to each one the constituent parts of the antenna element 10, the feed transition section 20 is here excited by means of a stripline feed network 26. A probe 28 passes through a hole formed in one of the stripline ground planes to the stripline center conductor. The probe 28 is rigidly attached to the stripline center conductor by solder. The probe 28 is encapsulated by a sleeve (not shown) here of Teflon. Such sleeve here serves to provide impedance matching between the probe 28 and the impedance of the waveguide structure. Absorbing vanes 32, 34 are comprised of two small rods, each of a dielectric material, (here ceramic, having a dielectric constant of sixteen). Each one of the rods is comprised of two sections, semicircular in cross-section. One section has a resistive material 30, here tantalum, deposited on its flat surface and the other section has deposited thereon a suitable epoxy (not shown) to enable bonding of the two sections. The two absorbing vanes 32, 34 are located centrally with respect to the walls of the feed transition section 20, approximately one-quarter wavelength apart from each other and approximately one-half to three-quarters of a wavelength from the rear section 36 of the feed transition section 20. Feed transition section 20 is filled with a suitable ceramic material 38. The absorbing vanes 32, 34 are provided to absorb radio frequency energy having a horizontal polarization (i.e. an electric field parallel to the X axis) within the feed transition section 20. The absorbing vanes 32, 34 are inserted into the ceramic material 38 by first boring a pair of holes into the ceramic material 38 along the X axis, then inserting a small amount of epoxy, next inserting the absorbing vanes 32, 34 into such holes and finally affixing the vanes 32, 34 within the ceramic material by inserting a suitable epoxy into the portion of the holes which remains after insertion of the vanes 32, 34. The outer surfaces of the epoxy are covered by a conductive epoxy (not shown) to insure ground plane continuity for the outer wall of the feed transition section 20. The stripline feed 26 is bonded to the outer wall of the feed transition section 20. The stripline feed 26 is bonded to the outer wall of the feed transition section 20 by means of a suitable epoxy, not shown.

Each one of the pair of nonreciprocal quarter-wave plates 11, 13 is comprised of a set of four permanent magnets affixed around the waveguide section. The quarter-wave plates 11, 13 are adapted to transform the polarization of radio frequency energy passing therethrough as described in detail in U.S. Pat. No. 3,736,535 mentioned above. In particular, also referring to FIGS. 2 and 3, the north (N) and south (S) poles of each one of the four magnets in each one of the nonreciprocal quarter-wave plates 11, 13 are oriented as shown. The magnetic fields established within each nonreciprocal quarter-wave plate 11, 13 may then be represented by the arrows (not numbered) shown in FIGS. 2 and 3 respectively. That is, the pair of quarter-wave plates 11 and 13 are oriented with respect to each other such that their magnetic fields are oriented 45° with respect to each other as shown in FIGS. 2 and 3. If, then, the electric field of the radio frequency energy entering either one of such nonreciprocal quarter-wave plates is oriented 45° with respect to the magnetic flux established within such plate, such electric field may be considered to have orthogonal components, each such component being perpendicular to an orthogonal component of such flux. However, the direction of interaction between the applied magnetic field and the magnetic field associated with the radio frequency energy passing through the waveguide are such that each orthogonal electric field component will be opposite to the other. The result, then, is that the propagation constant of each orthogonal electric field component differs. Therefore, by choosing a proper magnetic filed strength and a proper length for each nonreciprocal quarter-wave plate, a 90° phase difference may be produced between two orthogonal electric field components, thereby producing the effect necessary for a "linear to circular" polarization transformation of radio frequency energy. If the electric field of such radio frequency energy is parallel with either one of the orthogonal magnetic fluxs produced within either quarter-wave plate 11, 13 the polarization of such radio frequency energy is unaffected by the magnetic flux produced within either such quarter-wave plate. Conversely, circularly polarized radio frequency energy introduced into either one of such nonreciprocal quarter-wave plates 11, 13 is converted into linearly polarized radio frequency energy, the electric field of such converted energy being oriented in accordance with the sense of circular polarization of the introduced radio frequency energy and the orientation of the magnetic flux associated with either such quarter-wave plate.

Further, in either nonreciprocal quarter-wave plate 11, 13 linearly polarized radio frequency energy introduced into one end of such plate is transformed to circularly polarized energy of a particular sense and circularly polarized radio frequency energy of the same sense introduced into the other end of either such nonreciprocal quarter-wave plate is transformed into linearly polarized radio frequency energy having an orientation orthogonal to the aforementioned linearly polarized radio frequency energy. On the other hand, circularly polarized radio frequency energy of the opposite sense introduced into such other end of such plate is transformed into linearly polarized radio frequency energy having the same orientation as the first mentioned linearly polarized radio frequency energy.

Reciprocal quarter-wave plate 14 here is constructed with a ceramic material 16 having a dielectric constant 13 and a ceramic material 18 having a dielectric constant of 38. Such materials are fastened to each other by means of a suitable epoxy (not shown), preferably one having a dielectric constant of 13. The reciprocal quarter-wave plate 14 is designed so that vertically or horizontally polarized radio frequency energy passes therethrough without any alteration in polarization. Such reciprocal quarter-wave plate 14 is, however, adapted to convert radio frequency energy having a linear polarization oriented 45° with respect to the X and Y axes into radio frequency energy having circular polarization. Referring also to FIG. 4, the length $l$ of the reciprocal quarter-wave plate 14 and the dimensions $a$,

*b* and *d* are chosen with regard to two constraints: (1), the differential phase shift along the X and Y axis must be 90°; and (2), the phase shift along the X axis must be a multiple of 180°. With such configuration vertically or horizontally polarized radio frequency energy, although each has a different propagation constant, passes through without any alteration in polarization. However, radio frequency energy having a pair of orthogonal components parallel to both the X and Y axis, respectively, (that is, an electric field oriented 45° with respect to the X and Y axis) has each one of such components propagate through the reciprocal quarter-wave plate with different propagation constants to effectuate a linear-to-circular polarization transformation. Conversely, circularly polarized radio frequency energy introduced into such reciprocal quarter-wave plate is converted into radio frequency energy having a linear polarization with an electric field oriented in accordance with the sense of the circular polarization of the introduced radio frequency energy. In particular, in reciprocal quarter-wave plate 14, linearly polarized radio frequency energy introduced into one end of such plate is transformed to circularly polarized radio frequency energy of a particular sense and circularly polarized radio frequency energy of the same sense introduced into the other end of such plate is transformed into linearly polarized radio frequency energy having the same orientation as the aforementioned linearly polarized radio frequency energy. Likewise, circularly polarized radio frequency energy of the opposite sense introduced into the other end of such plate is transformed into linearly polarized radio frequency energy having an orientation orthogonal to the first mentioned linearly polarized radio frequency energy.

Figure 6:
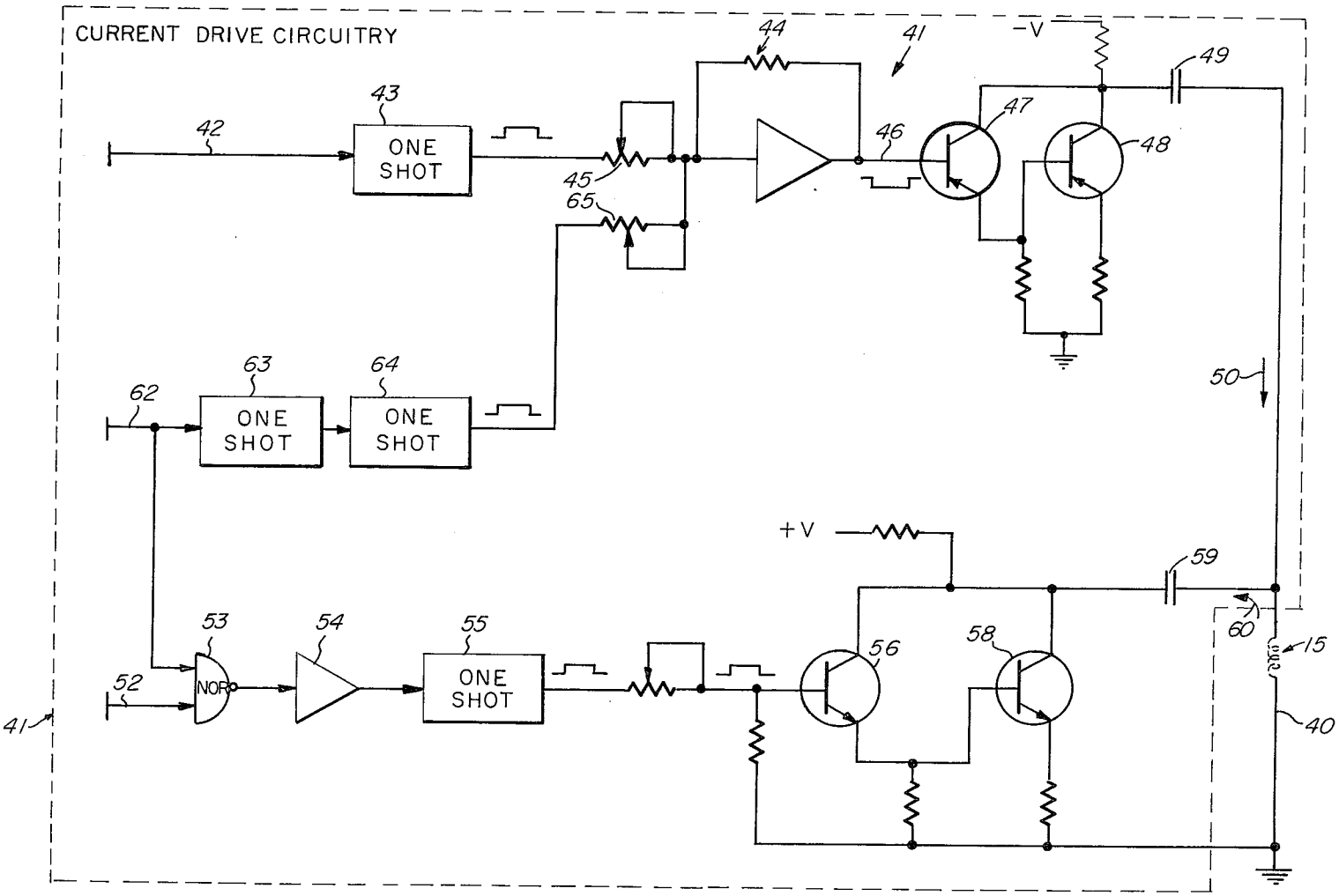
FIG. 6 is a schematic diagram for the current driver circuitry shown in FIG. 5.

The switchable quarter-wave plate 15 comprises a set of four ferrite pole pieces (not numbered) with substantially square hysteresis loops. Such pole pieces are positioned around the waveguide structure as shown in FIG. 5. A current carrying cable 40 is passed through each one of the ferrite pole pieces as shown to act as a conventional inductive load. Such cable is connected to current driver circuitry 41, the details of which are shown in FIG. 6 and now to be described. Switchable quarter-wave plate 15 is adapted to operate in one of three possible manners. To select operation in the first manner a trigger signal from any convenient source (not shown) is supplied to line 42. Such trigger signal is supplied to one shot multivibrator 43, here bing designed to supply a 100$\mu$ sec pulse of positive polarity to operational amplifier 44 through resistor 45. Operational amplifier 44 produces, in response to the positive polarity pulse, a negative polarity pulse to line 46 whose amplitude is, inter alia, determined by resistor 45. The pulse on line 46 turns transistors 47, 48 on and the amplitude of such pulse controls the current flow through such transistors, thereby causing capacitor 49 to discharge through cable 40 (in the direction indicated by arrow 50). The discharge current in the cable 40 is sufficient to drive each one of the ferrite pole pieces to saturation in a given direction. When the current stops flowing, the ferrite pole pieces are latched. The magnetic field of each ferrite pole piece, when latched, is represented here by arrows 51 in FIG. 5. It is noted that such arrows 51 are here aligned with the arrows (not numbered) representative of the magnetic field associated with nonreciprocal quarter-wave plate 13 (FIG. 3).

To operate in the second manner, a trigger signal is supplied to line 52. Such trigger signal passes through NOR gate 53 and inverter 54 to one shot multivibrator 55. One shot multivibrator 55, in response to such trigger signal, produces a 100 $\mu$sec. positive polarity pulse. Such pulse turns transistors 56, 58 on and the amplitude of such pulse controls the current through such transistors, thereby causing capacitor 59 to discharge through cable 40 in the direction indicated by arrow 60. The amount of such current is sufficient to drive and latch the ferrite pole pieces in a magnetic state opposite to that aforementioned. The magnetic field associated with such state is changed 180° with respect to the arrows 51. (FIG. 5).

To operate in the third manner, a trigger signal is applied to line 62. Such trigger signal passes through NOR gate 53 to latch the ferrite pole pieces as just described, regardless of the magnetic state of such pole pieces just prior to the application of the trigger pulse. However, the trigger signal on line 62 is also applied to one shot multivibrator 63 which provides a delay, here 120 $\mu$sec., before a one shot multivibrator 64 provides a positive polarity pulse of 100 $\mu$sec. duration to a resistor 65. Such delayed pulse then causes a current flow through cable 40 in the direction indicated by arrow 50. The value of resistor 65 is such that the current through the cable 40 will cause the ferrite pole pieces ultimately to be essentially demagnetized.

As will become apparent hereinafter during either the transmission or reception, the radio frequency energy passing through the portion of the waveguide structure between the nonreciprocal quarter-wave plate 13 and the switchable quarter-wave plate 15 will be circularly polarized. The phase of such circularly polarized energy is controlled by a phase shifter section 17, here a Faraday rotator, the details of which are described in U.S. Pat. No. 3,736,535 mentioned above and also in copending patent application Ser. No. 186,128 filed Oct. 4, 1971, entitled "Phased Array System" bt V. L. Heeren, J. Howell and C. D. Reis, assigned to the same assignee as the present invention, now U.S. Pat. No. 3,775,769 issued Nov. 27, 1973.

Radiator 22 provides impedance matching to free space over a relatively wide range of scan angles. A radiator which may be used as radiator 22 is described in detail in patent application Ser. No. 369,028 filed June 11, 1973, entitled "Waveguide Device" by Jerome D. Hanfling and assigned to the same assignee as the present invention now U.S. Pat. No. 3,851,281 issued Nov. 26, 1974 entitled "Impedance Matched Waveguide Device.". Here such radiator 22 includes a pair of dielectric circular discs (not numbered) here of cordierite and a square waveguide section here having Alumina as a dielectric disposed within such square waveguide section.

In operation, referring to FIG. 1, when switchable quarter-wave plate 15 is operating in its first manner, vertically polarized radio frequency energy, as indicated by arrow 24, introduced into the feed transition section 20 is converted to circularly polarized radio frequency energy (of a particular sense) by nonreciprocal quarter-wave plate 13. Such circularly polarized radio frequency energy passes through the ferrite phase shifter section 17. The circularly polarized radio frequency energy is then converted to linearly polarized radio frequency energy by switchable quarter-wave plate 15. Because of the here assumed orientation of the magnetic field associated with the switchable quarter-wave plate 15, the direction of polarization will then be horizontal. Because of the orientation of the magnetic flux in the nonreciprocal quarter-wave plate 11, the horizontally polarized radio frequency energy passes through such quarter-wave plate with unchanged polarization. The horizontally polarized radio frequency energy then passes through reciprocal quarter-wave plate 14 and is also unchanged in polarization for the reasons mentioned above Therefore, horizontally polarized radio frequency energy is transmitted by antenna element 10. During reception a portion of the horizontally polarized radio frequency energy reflected by an object enters radiator 22. Such reflected radio frequency energy remains horizontally polarized as it passes through reciprocal quarter-wave plate 14 and nonreciprocal quarter-wave plate 11. However, switchable quarter-wave plate 15 converts the horizontally polarized radio frequency energy to circularly polarized radio frequency energy. The sense of such circularly polarized radio frequency energy will be of a reversed sense. Such circularly polarized radio frequency energy passes through the ferrite phase shifter section 17. However, because the sense of the circularly polarized radio frequency energy is now reversed during reception from the sense of such circular polarization during transmission, the phase shift control signal supplied to the ferrite phase shifter section 17 from a beam steering computer (not shown) need not be changed between transmission and reception. The phase shifted circularly polarized radio frequency energy therefore passes through nonreciprocal quarter-wave plate 13 where it is again converted to vertically polarized radio frequency energy. Such vertically polarized radio frequency energy is then coupled to stripline 26.

When the direction of magnetization of the ferrite pole pieces in the switchable quarter-wave plate 15 is reversed, (that is, such switchable quarter-wave plate is operating in the second manner) vertically polarized radio frequency energy introduced through feed transition section 20 is again converted into circularly polarized radio frequency energy by nonreciprocal quarter-wave plate 13. However, because the direction of the magnetic flux in the switchable quarter-wave plate 15 has changed 180°, circularly polarized radio frequency energy passing through the phase shifter section 17 is now converted to vertically polarized radio frequency energy by the switchable quarter-wave plate 15. Such vertically polarized radio frequency energy is still unaltered in polarization by nonreciprocal quarter-wave plate 11 and nonreciprocal quarter-wave plate 14 for reasons mentioned above. During reception a portion of the vertically polarized radio frequency energy reflected by an object is received by the radiator 22. Such received radio frequency energy passes unaltered in polarization through quarter-wave plates 14 and 11 and is converted into circularly polarized energy by means of switchable quarter-wave plate 15. In this case, however, the sense of the circular polarization of the radio frequency energy passing through the phase shifter section 17 is reversed from the sense of the circularly polarized radio frequency energy in that section during transmission. The phase shifted circularly polarized radio frequency energy is transformed to vertically polarized energy by nonreciprocal quarter-wave plate 11.

When the ferrite pole pieces in the switchable quarter-wave plate are demagnetized, (that is when such quarter-wave plate is operating in the third manner) vertically polarized radio frequency energy introduced through the feed transition section 20 into the waveguide structure is again converted to circularly polarized radio frequency energy by nonreciprocal quarter-wave plate 13. Because of the condition of the switchable quarter-wave plate, such circularly polarized radio frequency energy remains circularly polarized. The polarization of the radio frequency energy entering the nonreciprocal quarter-wave plate 11 is again converted into linearly polarized radio frequency energy by such nonreciprocal quarter-wave plate. It is noted, however, that the orientation of the electric field of such linearly polarized radio frequency energy is 45° with respect to both the X and Y axes. Therefore, as described above, reciprocal quarter-wave plate 14 transforms the polarization of the radio frequency energy from linear polarization to circular polarization. During reception, if a portion of the circularly polarized transmitted radio frequency energy has been reflected from a "single bounce" reflecting surface, such as a raindrop, such radio frequency energy is circularly polarized and remains circularly polarized without change in sense. The portion of such radio frequency energy received by radiator 22 passes through reciprocal quarter-wave plate 14 and is transformed into linearly polarized radio frequency energy, such energy having an electric field oriented 45° with respect to the X and Y axes. Such linearly polarized radio frequency energy is converted to circularly polarized radio frequency energy of the same sense by nonreciprocal quarter-wave plate 11. The circularly polarized radio frequency energy is converted into horizontally polarized radio frequency energy by nonreciprocal quarter-wave plate 13 Such horizontally polarized radio frequency energy is then almost completely absorbed by absorbing vanes 32, 34. On the other hand, the portion of the transmitted circularly polarized radio frequency energy reflected by a "double bounce" object, such as an aircraft, and received by radiator 22, is also circularly polarized; however, the polarization of such radio frequency energy has a sense reversed from the sense of polarization associated with the radio frequency energy reflected from a single bounce object. Therefore, upon passing through the described waveguide structure, such radio frequency energy is vertically polarized and, accordingly, is not absorbed by the absorbing vanes 32, 34 but rather is passed to the stripline feed 26.

Having described a preferred embodiment of the invention, numerous variations may now become apparent to those skilled in the art. For example, the current driver circuit described herein may be replaced with driver circuitry similar to that used with analog phase shifters as described in *Radar Handbook* by M. I. Skolnik, McGraw-Hill Book Company, 1970, pgs. 12-43 to 12-45. Further, the position of the reciprocal quarter-wave plate 14 and the nonreciprocal quarter-wire plate 11 may be interchanged with appropriate changes to the waveguide structure. It is felt therefore that the invention is not limited in scope to the particular embodiments herein shown, but only by the spirit and scope of the appended claims.

What is claimed is:

1. An antenna element comprising:

a. a waveguide means for passing radio frequency energy introduced thereto and for radiating such radio frequency energy;

b. means for transforming the polarization of the radio frequency energy as such energy passes through the waveguide means for radiating such radio frequency energy selectively with either linear or circular polarization, such transforming means including i. a first and a second nonreciprocal quarter-wave plate having field orientations within the waveguide means effectively 45° with respect to each other;

ii. a third nonreciprocal quarter-wave plate disposed between the first and the second nonreciprocal quarter-wave plate;

iii. a reciprocal quarter-wave plate disposed between thee radiating end of the waveguide means and the third nonreciprocal quarter-wave plate; and iv. means for operating the third nonreciprocal quarter-wave plate in a selected one of a plurality of manners, such means including means for switching to align the field orientation of the third nonreciprocal quarter-wave plate with the field orientation of the first quarter-wave plate when a first one of the plurality of manners is selected, for switching to reverse the field orientation of the third nonreciprocal quarter-wave plate when a second one of the plurality of manners is selected, and for switching to eliminate the field of the third nonreciprocal quarter-wave plate when a third one of the plurality of manners is selected; and, c. feed means connected to the waveguide means for introducing linearly polarized radio frequency energy within the waveguide means, such feed means including means for absorbing linearly polarized radio frequency energy having a polarization orthogonal to the polarization of the introduced radio frequency energy.

2. The antenna recited in claim 1 including additionally a phase shifter section disposed between the third nonreciprocal quarter-wave plate and the first nonreciprocal quarter-wave plate.

3. The antenna element recited in claim 2 wherein the feed means is disposed adjacent to the first nonreciprocal quarter-wave plate.

* * * * *

UNITED STATES PATENT OFFICE

CERTIFICATE OF CORRECTION

Patent No. 3,938,158 Dated February 10, 1976

Inventor(s) James D. Birch, Max C. Mohr and Stephen R. Monaghan

It is certified that error appears in the above-identified patent and that said Letters Patent are hereby corrected as shown below:

Column 3, line 4 change "ratio" to --radio--; and

Signed and Sealed this

Nineteenth Day of October 1976

[SEAL]

*Attest:*

RUTH C. MASON
*Attesting Officer*

C. MARSHALL DANN
*Commissioner of Patents and Trademarks*